US007708464B2

(12) United States Patent
Tanaka

(10) Patent No.: US 7,708,464 B2
(45) Date of Patent: May 4, 2010

(54) DEAERATION VALVE AND COMPRESSION BAG EQUIPPED THEREWITH

(75) Inventor: Kazuya Tanaka, Kashihara (JP)

(73) Assignee: Mikio Tanaka, Tenri-Shi (JP)

( * ) Notice: Subject to any disclaimer, the term of this patent is extended or adjusted under 35 U.S.C. 154(b) by 1051 days.

(21) Appl. No.: 10/571,899

(22) PCT Filed: Sep. 2, 2005

(86) PCT No.: PCT/JP2005/016089

§ 371 (c)(1),
(2), (4) Date: Mar. 14, 2006

(87) PCT Pub. No.: WO2007/029292

PCT Pub. Date: Mar. 15, 2007

(65) Prior Publication Data

US 2008/0253698 A1 Oct. 16, 2008

(51) Int. Cl.
*B65D 30/24* (2006.01)
*B65D 33/01* (2006.01)
*B65D 81/20* (2006.01)

(52) U.S. Cl. ..... 383/100; 383/44; 383/48; 383/101; 206/524.8

(58) Field of Classification Search ..... 383/36, 383/44, 45, 48, 57, 100, 10, 101; 206/524.8
See application file for complete search history.

(56) References Cited

U.S. PATENT DOCUMENTS 2,799,314 A * 7/1957 Dreyer et al. ..... 383/44
2,800,269 A * 7/1957 Smith ..... 383/38
3,263,903 A * 8/1966 Waller et al. ..... 383/44
3,343,463 A * 9/1967 Kurt et al. ..... 493/201
3,806,025 A * 4/1974 Marshall ..... 383/49
4,834,554 A * 5/1989 Stetler et al. ..... 383/100
4,865,464 A * 9/1989 Enzu ..... 383/44
5,540,500 A * 7/1996 Tanaka ..... 383/43
5,701,996 A * 12/1997 Goto et al. ..... 206/287
6,499,600 B2 * 12/2002 Koyanagi ..... 206/524.8
6,622,857 B2 * 9/2003 Ohtsubo et al. ..... 206/287
7,448,803 B2 * 11/2008 Ootsubo ..... 383/100

(Continued)

FOREIGN PATENT DOCUMENTS

JP 58-112955 A 7/1983

(Continued)

*Primary Examiner*—Jes F Pascua
(74) *Attorney, Agent, or Firm*—Birch, Stewart, Kolasch & Birch, LLP

(57) ABSTRACT

A deaeration valve comprising two valve films 11, 12 of synthetic resin that put one on the other, having an air passage 2 defined by two seal sections 21, 22 formed by means of bonding parts of the valve films together, wherein the inlet 2*a* of the air passage 2 is defined by the straight line linking the respective upward flow side end sections 21*a*, 221*a* of the seal sections 21, 22; the outlet 2*b* of the air passage is defined by the straight line linking the respective downward flow side end sections 21*b*, 223*b* of the seal sections 21, 22; and in at least one of the seal sections 21, 22, the valve films 11, 12 are not bonded together at the line of extension 21*c*, 223*c* of the seal section 21, 22, situated on the downward flow side of the downward flow side end section 21*b*, 223*b* of the seal section 21, 22.

18 Claims, 7 Drawing Sheets

U.S. PATENT DOCUMENTS

2002/0044702 A1* 4/2002 Koyanagi ..... 383/103
2004/0057636 A1* 3/2004 Ishizaki ..... 383/44

FOREIGN PATENT DOCUMENTS

JP 6-697 Y2 1/1994
JP 9-290840 A 11/1997
JP 09310770 A * 12/1997
JP 10-706 A 1/1998

* cited by examiner

DEAERATION VALVE AND COMPRESSION BAG EQUIPPED THEREWITH

FIELD OF THE INVENTION

The present invention relates to a deaeration valve using two valve films made of synthetic resin, which is able to pass an airflow in one direction, and to a compression bag equipped with this deaeration valve.

BACKGROUND ART

Patent Reference No. 1: JP utility model application laid-open No. H06-697

Conventionally, compression bags are known in which an item for storage which is bulky as a result of containing air, such as clothing, bedding or the like, is contained, and then compressed by expelling the air contained therein, in such a manner that the item can be stored in a compact fashion.

The compression bag is provided with an opening for introducing and removing the item for storage, and this opening can be closed to seal off the interior of the bag hermetically, by means of a zip fastener or the like. Many compression bags are provided with deaeration valves having an air passage for expelling air from the interior of the bag.

There are deaeration valves having a composition in which two valve films made of synthetic resin are superimposed on each other. In these valves, rectangular valve films are used, and an air passage is provided by seal sections formed by bonding the longitudinal side edges of the valve films together, and air is allowed to pass through the two valve films from an inlet to an outlet, and the air passage is closable by the two valve films that closely contact together.

This deaeration valve has a simple structure, but there are drawbacks in slackening of the valve films and inverse flow of air. One of the reasons for this slackening is thought to be local instability in the tension of the valve films which occurs as a result of the fixed positional relation between the films in the aforementioned seal sections.

On the other hand, in one example of a device aimed at preventing inverse flow in a deaeration valve having the aforementioned structure, the patent reference No. 1 proposes bending of the air passage. However, although this deaeration valve makes it less liable for inverse flow to occur, it does not resolve the aforementioned problem, namely, the fact that the valve films are fixed together in the seal sections, thereby producing local instabilities in the tension of the valve films.

In view of the circumstances, it is an object of the present invention to provide a deaeration valve, and a compression bag equipped with a deaeration valve, whereby the tension of the valve film can be stabilized, and inverse flow of air can be prevented effectively in spite of a simple structure.

DISCLOSURE OF THE INVENTION

In order to achieve the aforementioned object, a first aspect of the present invention according to claim 1 provides a deaeration valve 1 comprising two films 11, 12 of synthetic resin that are placed one on the other and bonded at parts thereof together. An air passage 2 is formed that allows to pass air through the valve films from an inlet 2*a* to an outlet 2*b* and closable by means of the valve films 11, 12 that closely contact together. The air passage 2 is defined by two seal sections 21, 22, which are formed by bonding the valve films 11, 12 together. The inlet 2*a* of the air passage 2 is defined by the straight line linking respective upward flow side end sections 21*a*, 221*a* of the seal sections 21, 22, while the outlet 2*b* of the air passage 2 is defined by the straight line linking respective downward flow side end sections 21*b*, 223*b* of the seal sections 21, 22. At least one of the downward flow side end sections 21*b*, 223*b* of the seal sections 21, 22 and the downward flow side edges 11*b*, 12*b* of the valve films 11, 12 are separated. A passage extension section 31 is provided on the downward flow side of the air passage 2, and is defined by the outlet 2*b* of the air passage 2, the line of extension 21*c*, 223*c* of the seal section 21, 22 on the downward flow side from the downward flow side end section 21*b*, 223*b* of at least one of the seal sections 21, 22, and the downward flow side edges 11*b*, 12*b* of the valve films 11, 12. The valve films 11, 12 are not bonded together at the lines of extension 21*c*, 223*c*.

A second aspect of the present invention according to claim 2 provides the deaeration valve 1 according to claim 1, which further comprises a non-sealed section 3 comprising a passage extension section 31 and a free section 32. The free section 32 is adjacent to the passage extension section 31 or to the air passage 2 and the passage extension section 31. The passage extension section 31 and the free section 32 are bounded by the line of extension 21*c*, 223*c* that defines the passage extension section 31. The portions of valve film 11, 12 constituting the passage extension section 31 and the free section 32 form a single body.

A third aspect of the present invention according to claim 3 provides the deaeration valve according to claim 1 or 2, wherein the dimension L2*b* between the respective end sections of the first side seal section 21 and the second side seal section 22 at the outlet of the air passage 2 is smaller than the dimension L2*a* between the respective end sections at the inlet of the air passage 2.

A fourth aspect of the present invention according to claim 4 provides the deaeration valve according to claim 3, wherein the first side seal section 21 has a linear form, and the second side seal section 22 comprises three sections that are an introduction section 221, an intermediate section 222, and an expulsion section 223. The intermediate section 222 connects between the introduction section 221 and the expulsion section 223. Regarding the second side seal section 22, the intermediate section 222 is formed closer to the first side seal section 21 than the introduction section 221, and the expulsion section 223 is formed closer to the first side seal section 21 than the intermediate section 222. The inlet 2*a* of the air passage 2 is defined by the upward flow side end section 221*a* of the introduction section 221 and the upward flow side end section 21*a* of the first side seal section 21, while the outlet 2*b* of the air passage 2 is formed by the downward flow side end section 223*b* of the introduction section 223 and the downward flow side end section 21*b* of the first side seal section 21. The downward flow side end section 223*b* of the second side seal section 22 is formed further towards the upward flow side than the downward flow side end section 21*b* of the first side seal section 21. The free section 32 being formed adjacent to the air passage 2 and the passage extension section 31 is provided.

A fifth aspect of the present invention according to claim 5 provides the deaeration valve according to any one of claims 1 to 4, wherein, in the air passage 2, the upward flow side edge 11*a*, 12*a* of the valve films 11, 12 that are placed one on the other, and the upward flow side edge 12*a*, 11*a* of the other of the valve films 12, 11 are disposed at least respectively in staggered positions towards the upward flow side and the downward flow side.

A sixth aspect of the present invention according to claim 6 provides the deaeration valve according to any one of claims 1 to 5, wherein an inert liquid 4 such as silicon oil is disposed on at least part of the inner surfaces of the valve films 11, 12 in the air passage 2.

A seventh aspect of the present invention according to claim 7 provides a compression bag equipped with a deaeration valve. As a compression bag 5, it is formed with at least two bag films 51, 52 of synthetic resin that are placed one on the other and bonded at parts thereof together. The compression bag comprises a storage section 62 provided with an opening 61, and a deaeration opening 63 for removing air in the storage section 62 other than the opening 61. The storage section 62 is able to contain an item for storage. The respective bag films 51, 52 have a rectangular shape in a plan view. The opening 61 is provided in the upper part of the compression bag 5 and is hermetically closable by a closing means 61*a*, while the deaeration opening 63 is provided in the lower part of the compression bag 5. A deaeration valve 1 according to any one of claims 1 to 6 is installed between the storage section 62 and the deaeration opening 63 with the inlet side of the air passage 2 towards the top and the outlet side towards the bottom. The installation of the deaeration valve 1 is achieved by forming a unifying seal section 64 where the valve films 11, 12 and the bag films 51, 52 are bonded together. Except through the air passage 2, air is prevented from flowing between the storage section 62 and the deaeration opening 63. A heat resistant coating 7 is disposed on at least part of the inner surfaces of the valve films 11, 12 in the air passage 2, and the part is taken in a portion that coincides with the unifying seal section 64.

An eighth aspect of the present invention according to claim 8 provides the compression bag equipped with a deaeration valve according to claim 7, wherein elongate films are used for the valve films 11, 12 and a plurality of the deaeration valves 1 are disposed parallel in the lengthwise direction of the valve films 11, 12 in such a manner that the air passages 2 and free sections 32 are respectively adjacent.

A ninth aspect of the present invention according to claim 9 provides the compression bag equipped with a deaeration valve according to claim 7 or 8, wherein the storage section 62 comprises an item storage portion 62*a* and an air introduction portion 62*b*, and the portions 62*a*, 62*b* are bounded by a valve protection seal 67. The valve protection seal 67 is formed by bonding the bag films 51, 52 together. Air is allowed to pass between the item storage section 62*a* and the air introduction portion 62*b*.

BRIEF DESCRIPTION OF THE DRAWINGS

FIG. 2 shows a deaeration valve relating to one embodiment of the present invention during deaeration, in which FIG. 2(A) is a plan view of the feature of the valve; FIG. 2(B) is a schematic cross-sectional view along B-B in FIG. 2(A); FIG. 2(C) is a schematic cross-sectional view along C-C in FIG. 2(A)

FIG. 3 shows a deaeration valve relating to one embodiment of the present invention, at the moment when deaeration has finished, in which FIG. 3(A) is a plan view of the feature of the valve; and FIG. 3(B) is a schematic cross-sectional view along E-E in FIG. 3(A), showing a state where the valve is installed on a compression bag.

FIG. 4 shows a deaeration valve relating to one embodiment of the present invention, after finishing deaeration, in which FIG. 4(A) is a plan view of the feature of the valve; FIG. 4(B) is a schematic cross-sectional view along F-F in FIG. 4(A), showing a state where the valve is installed on a compression bag; FIG. 4(C) is a schematic cross-sectional view along G-G in FIG. 4(A); and FIG. 4(D) is a schematic cross-sectional view along H-H in FIG. 4(A).

BEST MODE TO PRACTICE THE INVENTION

Figure 1A:
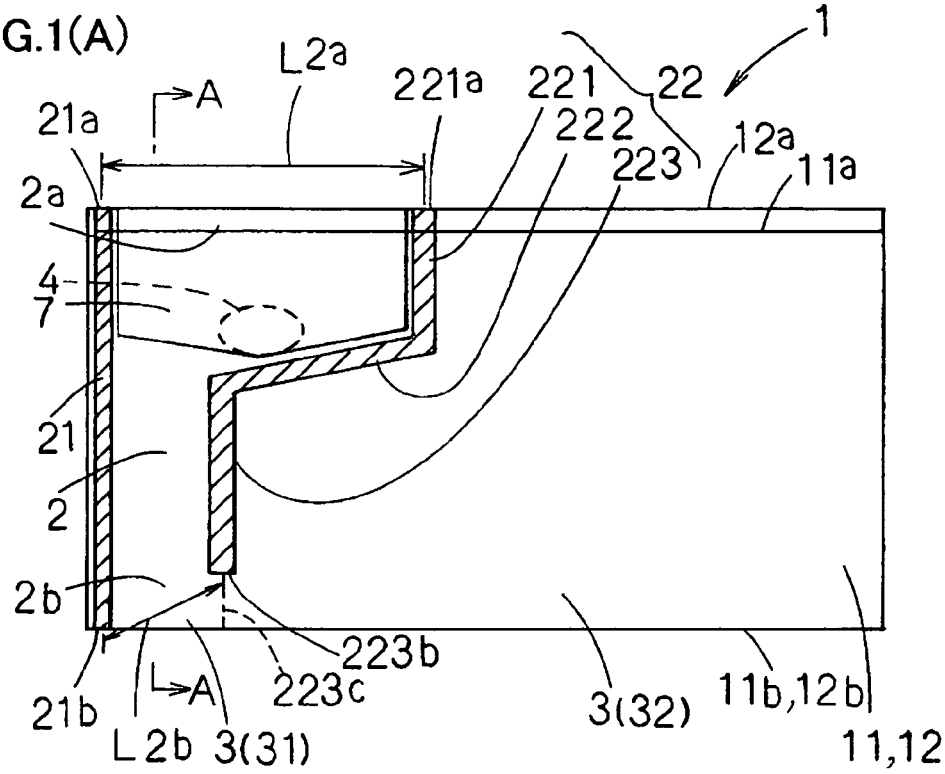
FIG. 1(A) is a plan view showing a deaeration valve relating to one embodiment of the present invention.
Figure 1:
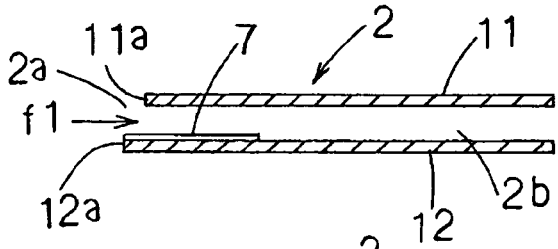
FIG. 1(B) is a schematic cross-sectional view along line A-A in FIG. 1(A), when the air passage is open.
FIG. 1(C) is a schematic cross-sectional view along line A-A in FIG. 1(A), when the air passage is closed.
Figure 1:
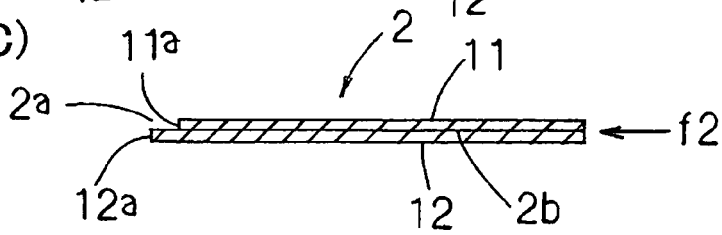
Figure 6:
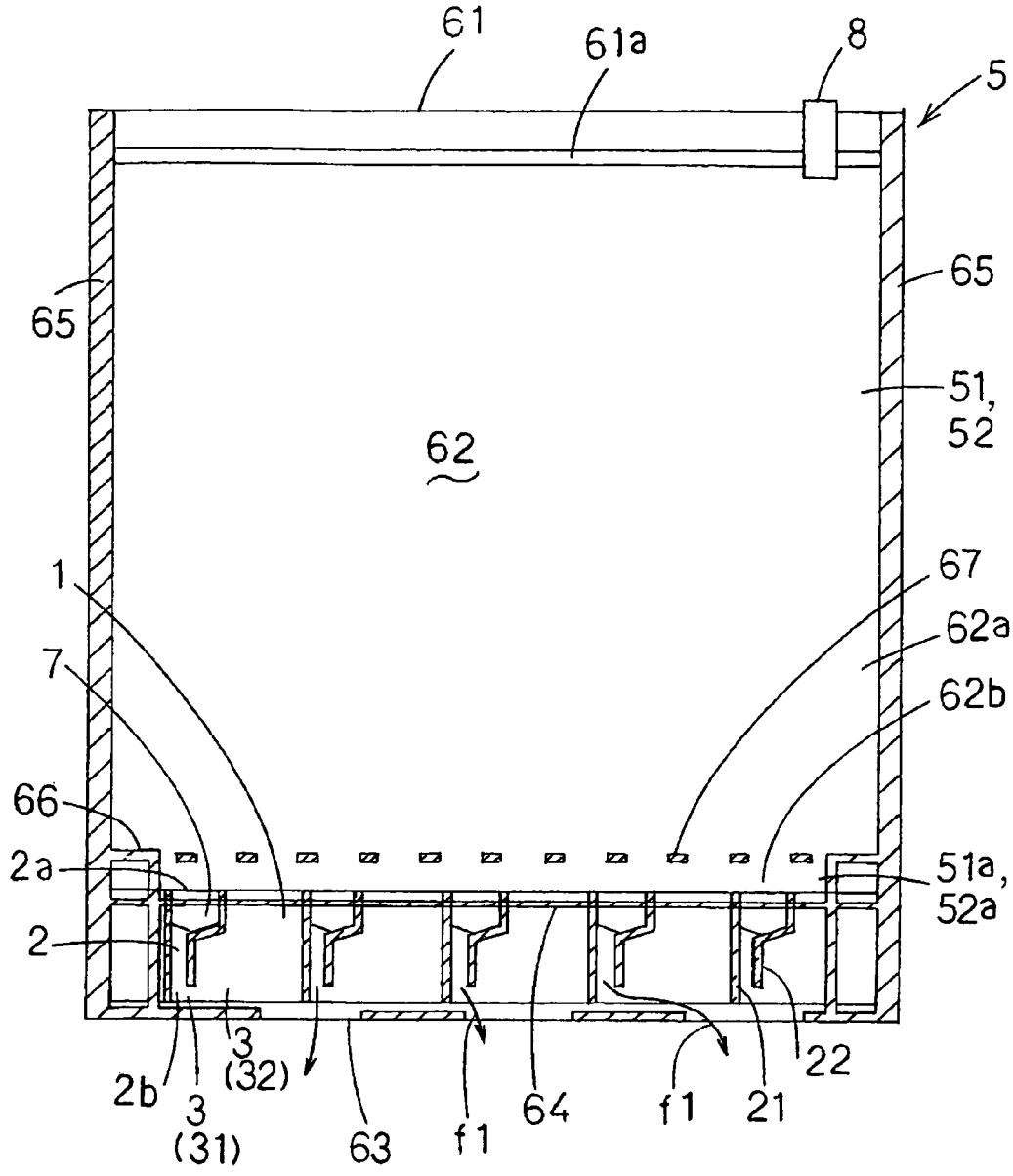
FIG. 6 is a plan view showing a compression bag equipped with a deaeration valve relating to one embodiment of the present invention.

One embodiment of the present invention will be described below with reference to the drawings. FIG. 1 is a plan view showing a deaeration valve according to the present embodiment, and FIG. 6 is a plan view showing a compression bag equipped with the deaeration valve of the present embodiment. The expressions "upward flow" and "downward flow" in the following description are based on the direction of the air flow when the air passage is open as shown in FIG. 1(B), and expressions indicating up, down, left and right relate to the positional situation shown in FIG. 1(A) and FIG. 6. Further, in expressions relating to "front" and "rear", "front" indicates the upper side in the state shown in FIGS. 1(B) and 1(C), and "rear" indicates the lower side in these drawings.

As shown in FIG. 1(A), the deaeration valve 1 according to the present embodiment is open with respect to air flow f1 in one direction from the upper side to the lower side (see FIG. 1(B)), and it is closed with respect to air flow f2 in the other direction from the lower side to the upper side (see FIG. 1(C)). This deaeration valve 1 is principally attached to a compression bag 5 such as that shown in FIG. 6, and is used in order to remove air in the storage section 62 of the compression bag 5. Equipping of this deaeration valve 1 is not limited to a compression bag as in the present embodiment, and it may also be applied to a bag that is used to be filled with gases such as air. Further, the deaeration valve 1 may also be used as a check valve for general fluids such as gases other than air and liquids such as water.

The deaeration valve 1 according to the present invention comprises two valve films 11 and 12 of synthetic resin that are placed one on the other. In these valve films 11 and 12, desirably, at least the surfaces forming the inner faces of the air passage 2 have weak contact property, thereby making the valve films 11 and 12 readily closely contact together. The valve films 11 and 12 used in the present embodiment have a rectangular shape as shown in FIG. 1, but they may also have another shape.

By bonding together a portion of the valve films 11 and 12, for example, by heat seal, an air passage 2 is provided where air is allowed to pass through the valve films 11 and 12 from an inlet 2*a* to an outlet 2*b*, and it is closable by the valve films 11 and 12 that closely contact together. This air passage 2 is defined by the two seal sections 21, 22 formed by bonding the valve films 11 and 12 together.

When the air flow f1 passes in the aforementioned direction, as shown in FIG. 1(B), the valve films 11 and 12 are pushed apart forcibly and opened by the air flow f1. However, in all other cases, the valve films 11 and 12 closely contact together, as shown in FIG. 1(C). Therefore, the air passage 2 maintains a closed state in which the air flow f2 in the other direction is not allowed to pass. The detailed movement of the valve films 11 and 12 with the air passage 2 closed will be described hereinafter.

Figure 5:
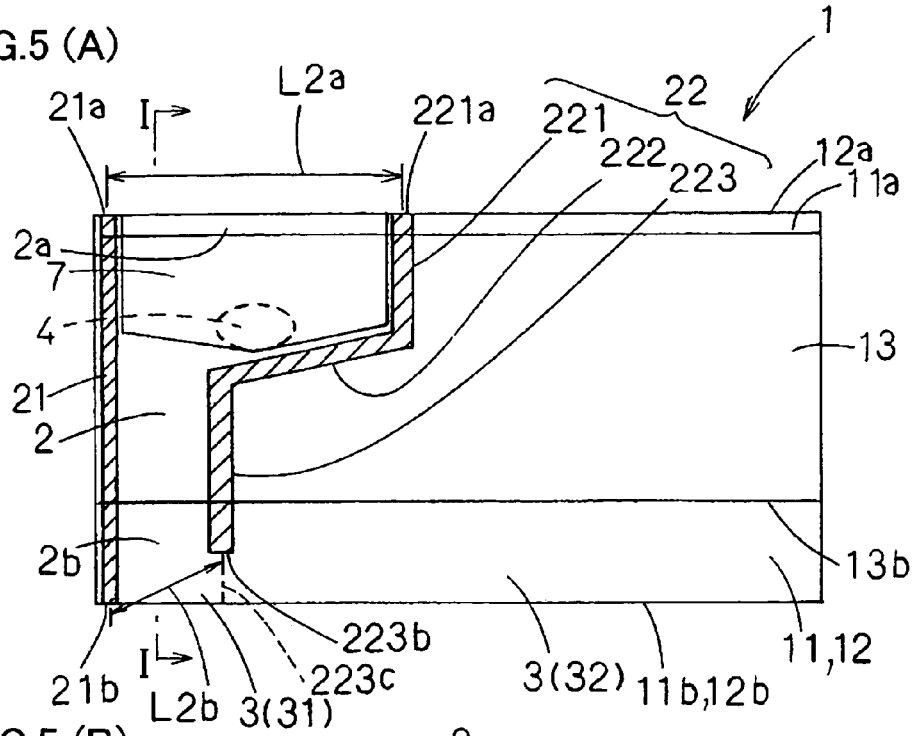
FIG. 5(A) is a plan view showing a deaeration valve relating to a further embodiment of the present invention.
FIG. 5(B) is a schematic cross-sectional view along line I-I in FIG. 5(A), when the air passage is open.
FIG. 5(C) is a schematic cross-sectional along line I-I in FIG. 5(A), when the air passage is closed.
Figure 5:
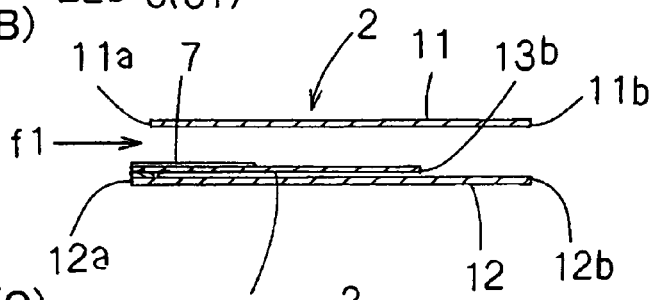
Figure 5:
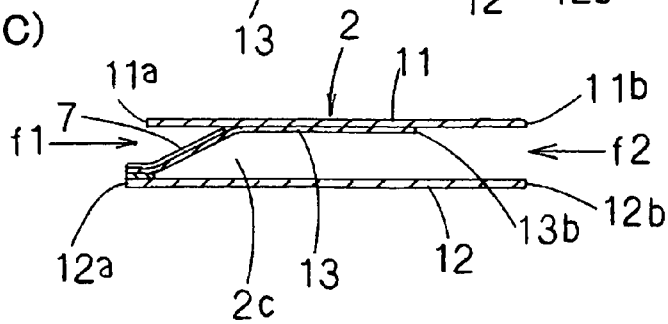

In the present embodiment, the air passage 2 is constituted by the two valve films 11 and 12, but as shown in FIG. 5, a structure may also be adopted in which an intermediate film 13 is disposed between the two valve films 11 and 12, wherein the base end side of the intermediate film 13 is bonded to the rear side valve film 12, as shown in FIG. 5(B), and the front end side thereof is movable inside the air passage 2 and able to make a close contact to the front side valve film 11, as shown in FIG. 5(C). The air passage 2 may have a structure to be closable by the intermediate film 13 and the front side valve film 11 that closely contact together, in addition to the close contact between the valve films 11 and 12 described above. In the example illustrated here, the downward flow side edge of the intermediate film 13 is positioned further toward the upward flow side than the downward flow side edges 11*b* and 12*b* of the valve films 11 and 12, but it is also possible for the positions of the respective edges 11*b*, 12*b* and 13*b* to be aligned with each other.

In the illustrated structure, desirably, the opposing faces of the rear side valve film 12 and the intermediate film 13, which are separated except the base end section when the air passage 2 is closed, do not have a weak contact property in order to make the films 12 and 13 less liable to closely contact together.

In the deaeration valve 1 according to the present embodiment, as shown in FIG. 1, the aforementioned seal sections 21 and 22 comprise a first side seal section 21 which has a linear shape extending in the up/down direction in the figure, following the left-hand edge of the valve films 11, 12 in the figure, and a second side seal section 22 which is formed further on towards the right-hand side with respect to the first side seal section 21 in the figure, and which extends in the up/down direction in the figure, but is formed in a bent fashion.

The second side seal 22 in the present embodiment comprises three sections; an introduction section 221, an intermediate section 222 and an expulsion section 223, from the top downwards in the drawings. The introduction section 221 is disposed toward the inlet side of the air passage 2, and the expulsion section 223 is disposed toward the outlet side of the air passage 2.

Here, the upward flow side end 221*a* of the introduction section 221 and the upward flow side end 21*a* of the first side seal section 21 form the inlet 2*a* of the air passage. Specifically, the inlet 2*a* is defined by the straight line which links the respective end sections 221*a* and 21*a*. Further, the downward flow side end 223*b* of the expulsion section 223 and the downward flow side end 21*b* of the first side seal section 21 form the outlet 2*b* of the air passage. More specifically, the outlet 2*b* is defined by the straight line which links the respective end sections 223*b* and 21*b*. The intermediate section 222 is connected between the introduction section 221 and the expulsion section 223.

In the second side seal 22, the intermediate section 222 is formed more closely to the first side seal section 21 than the introduction section 221, and the expulsion section 223 is formed more closely to the first side seal section 21 than the intermediate section 222. Accordingly, the dimension L2*b* between the respective end sections of the first side seal section 21 and the second side seal section 22 on the outlet side of the air passage 2 is smaller than the dimension L2*a* between the respective end sections on the inlet side. In other words, the width of the air passage 2 in the present embodiment narrows toward the downward flow side.

In the present embodiment, each of the introduction section 221, the intermediate section 222 and the expulsion section 223 is formed by straight lines, and as shown in FIG. 1, the introduction section 221 and the expulsion section 223 are formed in parallel with the first side seal section 21.

Figure 7A:
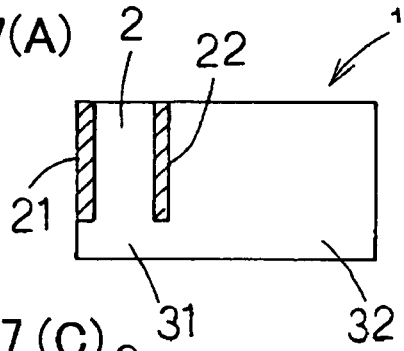
FIGS. 7(A)-7(H) are schematic plan views showing other embodiments of a deaeration valve relating to the present invention.
Figure 7B:
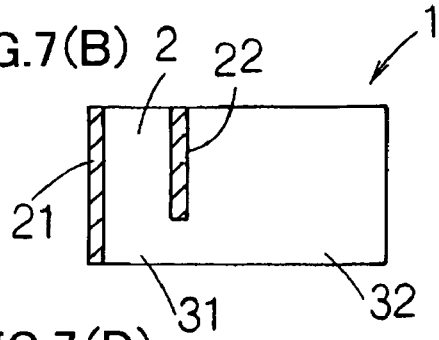
Figure 7:
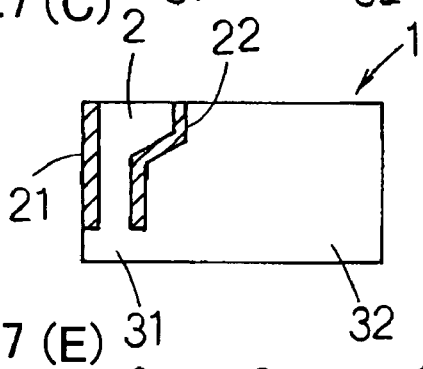
Figure 7:
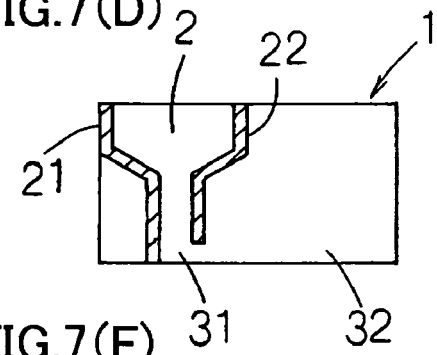
Figure 7:
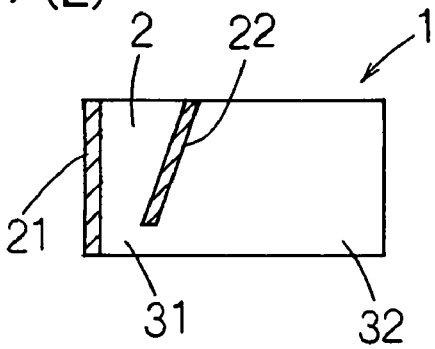
Figure 7F:
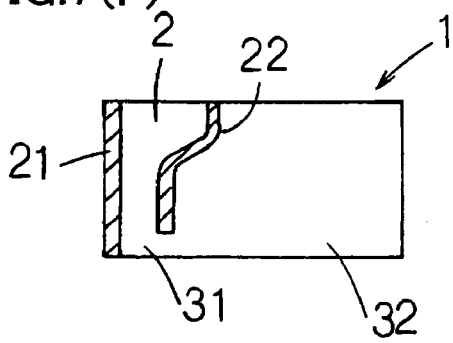
Figure 7:
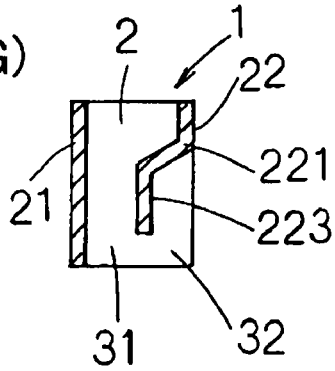
Figure 7:
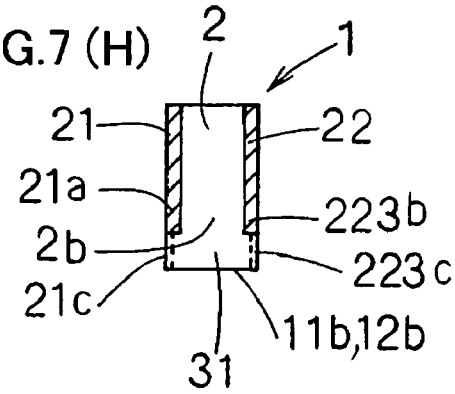

The mode of the seal sections 21 and 22 is not limited to that shown in the present embodiment, and it may be modified in various ways. For example, it is also possible to dispose the respective seal sections 21 and 22 in a parallel fashion, as shown in FIGS. 7(A), 7(B) and 7(H), by forming both of the seal sections 21 and 22 as straight lines, in such a manner that the air passage 2 does not narrow, and it is also possible to cause the air passage 2 to narrow by forming the second side seal section 22 as a straight line extending in an oblique direction, as shown in FIG. 7(E). Further, it is also possible to form the second side seal section 22 as a continuous curved line, as shown in FIG. 7(F). Moreover, in the case of the present embodiment, the first side seal section 21 is formed in a straight line and the second side seal section 22 is curved, but as shown in FIG. 7(D), it is also possible to form both of the seal sections 21 and 22 in curved lines, in a laterally symmetrical configuration.

Figure 2:
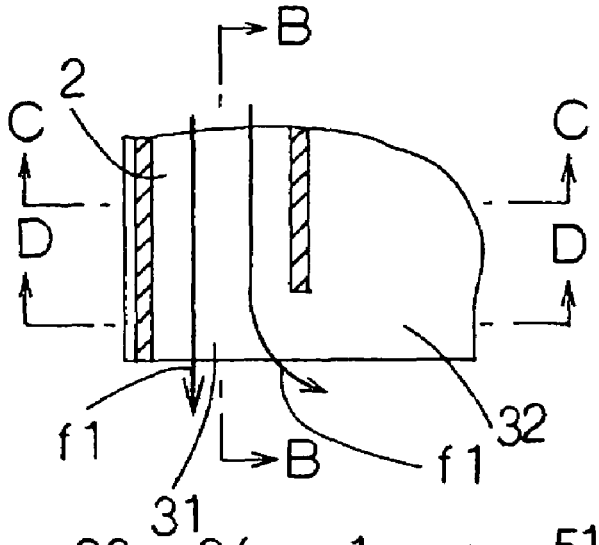
Figure 2:
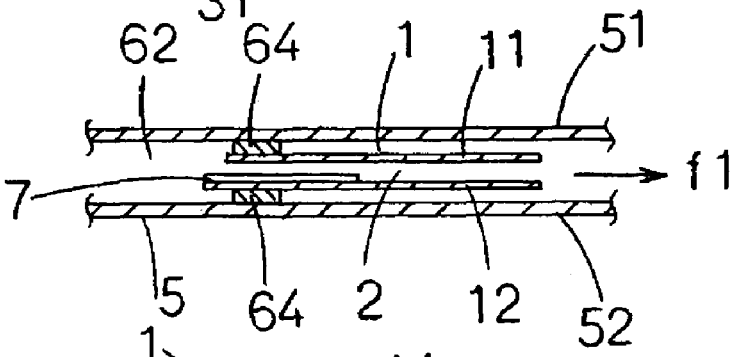
Figure 2:
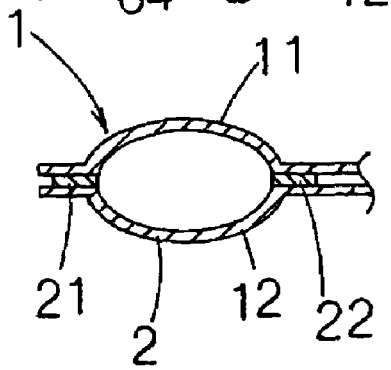
Figure 2D:
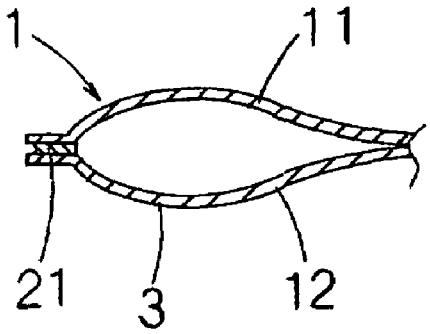
FIG. 2(D) is a schematic cross-sectional view along D-D in FIG. 2(A).

In the deaeration valve 1, as shown in FIG. 1(A), a non-sealed section 3 is formed outside the air passage 2. This non-sealed section 3 consists of a passage extension section 31 and a free section 32. Here, the passage extension section 31 is a portion located on the downward flow side from the outlet 2*b* of the air passage 2, and air that has passed through the air passage 2 continues to pass through this section. On the other hand, the free section 32 is a section in which the valve films 11 and 12 are closed by a unifying seal 64 formed when installing the valve on the compression bag 5, as shown in FIG. 6, for example, and air does not pass through this section as it does through the air passage 2. As shown in FIGS. 2(A) and 2(D), a part of the air flow into the air passage extension section 31 from the air passage 2 may pass through the free section 32.

Here, in the present embodiment, the downward flow side end 223*b* of the expulsion section 223 of the second side seal section 22 is formed further toward the upward flow side (the upper side in the figure) than the downward flow side end 21*b* of the first side seal section 21. Therefore, the passage extension section 31 in the deaeration valve 1 according to the present embodiment is a triangular-shaped portion defined by three lines; the outlet 2*b*, namely, the line linking the downward flow side end 21*b* of the first side seal section 21 and the downward flow side end 223*b* of the expulsion section 223 of the second side seal section 22, the downward flow side edges 11*b* and 12*b* of the valve films 11 and 12, and the line of extension 223*c* of the second side seal 22 on the downward flow side of the expulsion section 223 of the second side seal 22 (indicated by a broken line). When the air passage 2 is closed as shown in FIG. 1(C), the valve films 11 and 12 can closely contact together in this passage extension section 31, as the valve films 11 and 12 in the air passage 2.

In the present embodiment, as described above, by forming a first side seal section 21 further in the downward direction with respect to the second side seal section 22 in the figure, the first side seal 21 serves as a bone for the valve films 11 and 12 and prevents the valve films 11 and 12 from curling in the passage extension section 31, and hence there is no obstacle to close contact of the valve films 11 and 12 in the passage extension section 31.

As shown in FIGS. 7(A), 7(C) and 7(H), it is also possible to separate the downward flow side edges 11*b* and 12*b* of the valve films 11 and 12 from the downward flow side end 21*b* of the first side seal section 21, in such a manner that the respective seal sections 21 and 22, and the downward flow side edges 11*b* and 12*b* of the valve films 11 and 12 are not connected.

The free section 32 is adjacent to both the air passage 2 and the passage extension section 31. In other words, as shown in FIG. 1, in the non-sealed section 3, the portion to the left-hand side of the downward flow side line of extension 223*c* of the expulsion section 223 of the second side seal 22 forms the passage extension section 31, while the portion to the right-hand side forms the free section 32.

The passage extension section 31 and the free section 32 are connected, and distortion of the valve films 11 and 12 in the passage extension section 31 can be absorbed in the free section 32. Therefore, at least in the passage extension section 31, the tension of the valve films can be stabilized, consequently eliminating slackening or wrinkles, and the valve films 11 and 12 can be made reliably to closely contact together. Inverse flow of the air in the air passage 2 can be effectively prevented by locating the portion where the valve films 11 and 12 closely contact together in this way adjacent to the downward flow side of the air passage 2.

As described above, in order that a portion able to absorb distortion of the valve films 11 and 12 is ensured in the free section 32, it is necessary for the unifying seal 64 formed in installation to the compression bag 5, or for the seals formed separately from this in the free section 32 in order to prevent passage of air between the valve films 11 and 12, to be formed from the upward flow side edges 11*a* and 12*a* of the valve films 11 and 12 in the free section 32, up to the downward flow side end 223*b* of the expulsion section 223 of the second side seal 22, and a gap must be provided between these seals and the downward side edges 11*b* and 12*b* of the valve films 11 and 12.

Further, it is not essential to form the free section 32, and depending on the circumstances, it is possible for the non-sealed section 3 to comprise the passage extension section 31 only, as shown in FIG. 7(H). In this case, the passage extension section 31 is a square portion defined by the four lines; the outlet 2*b*, namely, the line linking the downward flow side end 21*b* of the first side seal section 21 and the downward flow side end 223*b* of the second side seal section 22, the downward flow side edges 11*b* and 12*b* of the valve films 11 and 12, the downward flow side line of extension 21*c* of the first side seal 21 and the downward flow side line of extension 223*c* of the second side seal 22.

Even in this case, it is possible to eliminate distortion of the valve films 11 and 12 in the passage extension section 31, by staggering the valve films 11 and 12 in the left/right direction in the figure, in the passage extension section 31, and like the foregoing, the tension of the valve films can be stabilized, and the valve films 11 and 12 can be made reliably to closely contact together without slackening or wrinkles.

In addition to the foregoing, in the present embodiment, the width of the air passage 2 is narrowed toward the downwards flow side, and the lateral dimension of the free section 32 is greater in the figure than the lateral dimension of the passage extension section 31 in FIG. 1(A). More specifically, in the present embodiment, the lateral dimension of the passage extension section 31 is 10 mm in the figure, whereas the lateral dimension of the free section 32 is 70 mm in the figure. Thus, by forming the free section 32 larger than the passage extension section 31 in this way, the above-described absorption of distortion in the free section 32 is performed more effectively.

Figure 3:
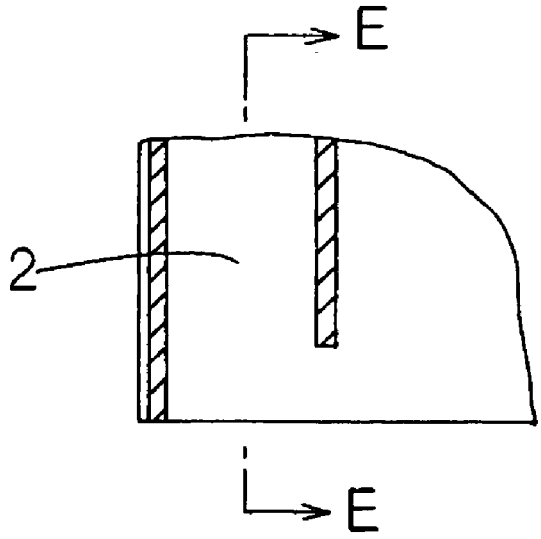
Figure 3:
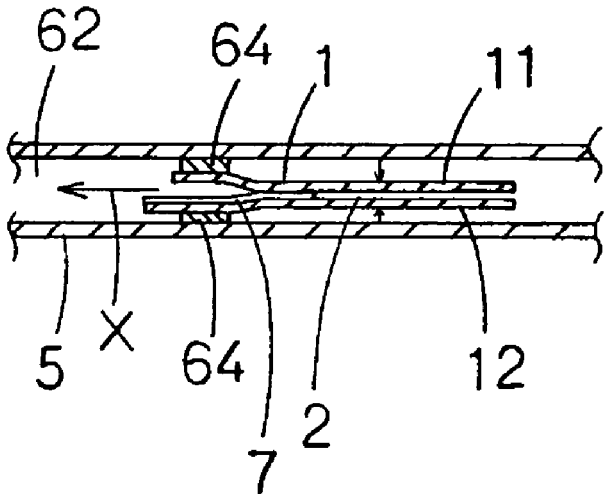
Figure 4:
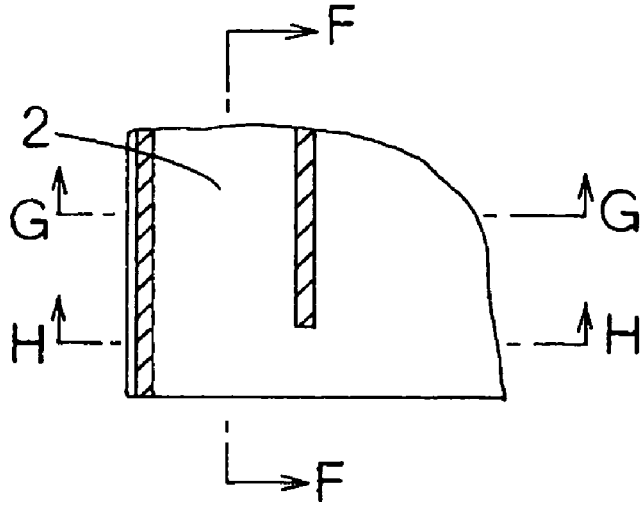
Figure 4:
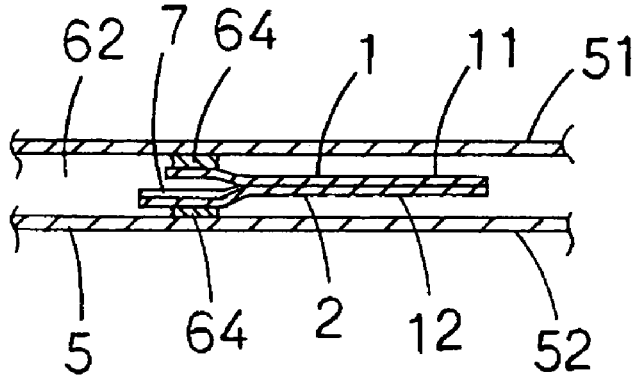
Figure 4:
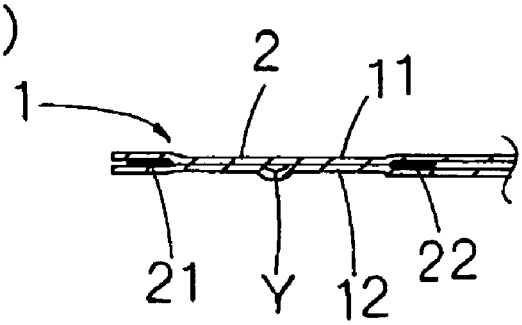
Figure 4:
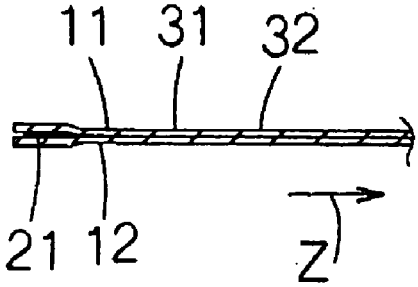

Here, the movement of the valve films 11 and 12 with the air passage 2 closed will be described in detail. As shown in FIG. 6, explained will be a state where a deaeration valve 1 is installed to the compression bag 5 described below. For description, the cross-sectional views in FIG. 2 to FIG. 4 exaggerate the size in the vertical direction of the figure, compared to an actual size.

First, when the air present inside the storage section 62 of the compression bag 5, shown in FIG. 6, is removed, the opening 61 is closed by the closing means 61*a*, and pressure is applied from outside the bag by rolling up the storage section 62 or doing like this. The air inside the storage section 62 forms an air flow f1 and passes through the air passage 2 of the deaeration valve 1, being expelled to the exterior of the bag. During this action the valve films 11 and 12 are pushed forcibly apart as shown in FIG. 2(B) of a sectional view along B-B. Here, as described above, since the second side seal section 22 ends at an intermediate point of the passage extension section 31, the air flow f1, as shown by the arrow in FIG. 2(A), also flows to the free section 32. FIG. 2(C) shows a sectional view along C-C in the lateral direction of the air passage 2 of the deaeration valve 1 in this case, while FIG. 2(D) shows a sectional view along D-D in the lateral direction of the passage extension section 31 and the free section 32 of the deaeration valve 1 in this case.

Next, FIGS. 3(A) and 3(B) show a momentary state when the aforementioned deaeration action has ended and the air flow f1 has ceased to pass through the air passage 2. In this case, the interior of the storage section 62 of the compression bag 5 assumes a state of negative pressure due to the expulsion of the air therein. Consequently, as shown in FIG. 3(B) of a sectional view along E-E, a force X acts on the valve films 11 and 12 in the air passage 2 so as to pull them towards the storage section 62, and hence the valve films 11 and 12 closely contact together.

This close contact of the valve films 11 and 12 occurs within a very short period of time, and hence there is virtually no inverse flow of air through the air passage 2 during the movement of the valve films 11 and 12.

Next, FIGS. 4(A) to 4(D) show the cases where the valve films 11 and 12 described above closely contact together, and the air passage 2 is closed. In this case, as shown in FIG. 4(B) of a sectional view along F-F, the valve films 11 and 12 normally closely contact to each other, thus closing the air passage 2 completely, but as shown in FIG. 4(C) of a sectional view along G-G in the lateral direction of the air passage 2 of the deaeration valve 1, a gap Y may occasionally arise between the valve films 11 and 12 due to slackening of the valve films 11 and 12. This is because the valve films 11 and 12 are fixed by the first side seal section 21 and the second side seal section 22, and hence relative displacement between the valve films 11 and 12 is restricted. On the other hand, in the passage extension section 31, the second side seal section 22 is not present, and therefore the valve films 11 and 12 are able to move in the direction of arrow Z, as shown in FIG. 4(D) of a sectional view along H-H in the lateral direction of the air passage 2 of the deaeration valve 1. Consequently, it is possible to absorb any displacement between the valve films 11 and 12 in the free section 32, and therefore, no gaps Y such as that in FIG. 4(C) occur, and the valve films 11 and 12 can be made reliably to closely contact together in the passage extension section 31.

Even in the deaeration valve 1 comprising of three films 11 to 13 illustrated in FIG. 5, like the foregoing, the valve films 11 and 12 closely contact together due to a force X that pulls them towards the storage section 62, but in addition to this, the intermediate film 13 and the front side valve film 11 closely contact together, as shown in FIG. 5(C), due to the aforementioned force X (in order to aid understanding, the valve films 11 and 12 are depicted in a separated fashion in FIG. 5(C)). Thereupon, a pocket-shaped space 2*c* may be provided between each of the valve films 11 and 12 and the intermediate film 13, but even in this case, the air flow f2 heading to flow inversely from the outlet 2*b* to the inlet 2*a* of the air passage 2 remains in this pocket-shaped space 2*c* and does not pass through the air passage 2.

Here, it is desirable that the dimension of the inlet 2*a* of the air passage 2 is large, since the air is guided smoothly into the air passage 2. Contrary to this, it is desirable that the dimension of the outlet 2*b* of the air passage 2 is small, since distortion is not liable to occur in the valve films 11 and 12. And, it is desirable that the dimension of the air passage 2 from the inlet 2*a* to the outlet 2*b* is large in order to ensure that the valve films 11 and 12 closely contact together in a reliable fashion. However, the dimensions of the respective sections of the deaeration valve 1 will be determined by taking things into consideration, because balancing the dimensions with the size of the compression bag 5 to which the valve is applied, or ensuring a large storage section 62 in the compression bag 5 are functionally required.

With respect to the aforementioned dimensions, desirably, the lateral dimension between the introduction section 221 and the first side seal section 21 in the vicinity of the inlet 2*a* of the air passage 2 is taken to be 20 mm-60 mm. In the present embodiment, it is set as 30 mm. Further, desirably, the lateral dimension between the expulsion section 223 and the first side seal section 21 in the vicinity of the outlet 2*b* of the air passage 2 is taken to be 5 mm-30 mm. In the present embodiment, it is set as 10 mm. Desirably, the dimension of the deaeration valve 1 in the vertical direction in the figure is 30 mm-100 mm. In the present embodiment, the dimension falls on the upward flow side edge 12*a* and the downward flow side edge 12*b* of the rear side valve film, and is taken as 45 mm.

As described above, since the distance between the first side seal section 21 and the second side seal section 22 can be set freely, it is possible to design a deaeration valve 1 capable of passing the optimum amount of air through the air passage 2 in accordance with the size of the compression bag 5 to which the deaeration valve 1 is installed.

In the present embodiment, the dimension of the deaeration valve 1 in the lateral direction in the figure is taken as 80 mm, and the free section 32 has a dimension sufficiently larger than the passage extension section 31, but depending on the circumstances, it is also possible to make the right-hand ends of the valve films 11 and 12 in the figure coincide with the introduction section 221 of the second side seal section 22, as shown in FIG. 7(G), in such a manner that the free section 32 is formed solely between the expulsion section 223 of the second side seal section 22 and the right-hand ends of the valve films 11 and 12 in the figure.

Here, as shown in FIGS. 1(A)-1(C), the upward flow side edge 11*a* of the front side valve film 11 and the upward flow side edge 12*a* of the rear side valve film 12, both of the valve films being placed one on the other, are disposed in staggered positions, displaced towards the upward flow side and the downward flow side. In the present embodiment, the upward flow side edge 11*a* of the front side valve film 11 is disposed towards the downward flow side. The aforementioned displacement is desirably set within the range of 1 mm to 10 mm, and more desirably, 3 mm to 5 mm. This displacement is not essential in the present invention, but is desirably to be provided. Also, this displacement may be called "step difference".

The displacement between the edges 11*a* and 12*a* is provided in order to avoid the inlet 2*a* of the air passage 2 from being sealed due to dislocation of the unifying seal section 64 that is a heat seal formed between the deaeration valve 1 and each of the bag films 51 and 52 when bonding the deaeration valve 1 onto the bag films 51 and 52 as described hereinafter. Further, it also serves to make the valve films 11 and 12 readily open up during deaeration, in such a manner that the air flow f1 can be smoothly introduced to the air passage 2 during deaeration.

In the present embodiment, as shown in FIG. 1(A), the dimension of the valve films 11 and 12 in the vertical direction in the figure is the same in the sections where the air passage 2 is formed and the other sections of the films, but it is effective as long as a displacement as described above exists in the section where the air passage 2 is formed.

An inert liquid 4, such as silicon oil, is at least partly disposed between the inner surfaces of the valve films 11 and 12. This liquid 4, due to its viscosity, has effects of reinforcing close contact between the valve films 11 and 12 when the air passage 2 is sealed. Desirably, the liquid 4 has a low viscosity, since it is difficult to open up the air passage 2 if the viscosity is too high. However, even it is low, needed is the viscosity of a level that does not allow the liquid to leak out from the air passage 2.

Next, the compression bag 5 equipped with the aforementioned deaeration valve 1 will be described. This compression bag 5 is formed with at least two bag films 51 and 52, which are made of synthetic resin and placed one on the other, by partly bonding the films together. The compression bag 5, as shown in FIG. 6, has a storage section 62 that includes an opening 61 and is able to contain an item such as clothing, and a deaeration opening 63 for removing air in the storage section 62 other than the opening 61. In the compression bag 5 according to the present embodiment, the opening 61, provided on the upper side in the figure, can be hermetically closed by a closing device, such as a fastener 61*a*, which closes by way of interlocking a recessed strip with a projecting strip. The deaeration openings 63 are provided on the lower side of the compression bag 5 in the figure. However, the opening 61 and the deaeration openings 63 can be positioned freely as long as they do not affect in the status where the deaeration valve 1 is attached, as described hereinafter. As regards the number of deaeration openings 63, in the compression bag 5 according to the present embodiment, three deaeration openings 63 are provided, but this number may be varied. Further, the bag films 51 and 52 according to the present embodiment have a rectangular shape in a plan view, but they may also be formed in a circular shape, a polygonal shape, or other forms variously.

The aforementioned deaeration valve 1 is, between the storage section 62 and a deaeration opening 63, attached with the inlet side of the air passage 2 towards the top and the outlet side towards the bottom. In the present embodiment, it is positioned within a range of 60 mm from the bottom of the compression bag 5. The deaeration valve 1 is attached through forming a unifying seal section 64 in which the valve films 11 and 12, and the bag films 51 and 52 are bonded together. Except the air passage 2, air does not flow between the storage section 62 and the deaeration opening 63 by forming this unifying seal section 64.

In the present embodiment, elongate films are used as valve films 11 and 12, and a plurality of deaeration valves 1 are disposed parallel in the lengthwise direction of these valve films, in such a manner that air passages 2 and free sections 32 are respectively adjacent, as shown in FIG. 6. Consequently, combined with similarly elongate bag films 51 and 52, compression bags 5 can be continuously manufactured, resulting in enhancement of productive efficiency. Moreover, when a plurality of deaeration valves 1 are aligned in this fashion, the number of air passages 2 per compression bag 5 can be readily increased as the compression bag 5 becomes larger, especially extending the lateral dimension, and hence it is not difficult in deaeration with a large-size compression bags 5.

Aforementioned unifying seal section 64 is formed by heat sealing. Therefore, a heat resistant coating 7 is provided at least on part of the inner surfaces of the valve films 11 and 12 in the air passage 2 of the deaeration valve 1, further coinciding with the unifying seal section, more specifically, as shown in FIG. 1(B), in the vicinity of the inlet 2*a* of the air passage 2, in order that the air passage 2 is not closed off due to melting of the valve films 11 and 12 under the effects of the heat applied during heat sealing. Here, "heat resistant" means a property whereby the material degenerates, by fusion, or the like, due to heat of the heat sealing operation, without affecting surrounding members, such as valve films 11 and 12.

In a deaeration valve 1 consisting of three films 11 to 13 as illustrated in FIG. 5, a heat resistant coating 7 is provided on the surface of the valve film 11 or the intermediate film 13 facing onto the space which is formed when the valve is opened and where the air flow f1 passes, specifically, on the surface adjacent to the inlet 2*a* of the air passage 2, as shown in FIG. 5(B).

In the compression bag 5 according to the present embodiment, the storage section 62 comprises an item storage portion 62*a* where an item is actually contained, and an air introduction portion 62*b* which lies between the item storage portion 62*a* and the deaeration valve 1, wherein valve protection seals 67 are formed at the boundary between these portions 62*a* and 62*b*. The valve protection seals 67 are formed by intermittently bonding the bag films 51 and 52 together. The interval at which the valve protection seals 67 are formed may be such that air is allowed to pass between the portions 62*a* and 62*b* and the seals do not affect the introduction of air into the air passages 2. In the present embodiment, the dimension of each valve protection seal 67 is 10 mm in the left/right direction in the figure, and the interval between the valve protection seals 67 is 25 mm. Further, the form of the valve protection seals 67 can be modified variously, however, it is desirable they have a form, for example, such as a circular form, which makes less resistance when air passes between the portions 62*a* and 62*b*.

Forming of the valve protection seals 67 in this way enables the item such as clothing contained in the item storage portion 62*a* to be prevented from being sucked into the air passages 2 by the air flows f1. And, even when stuffing of the item into the item storage portion 62*a* makes the bag films 51 and 52 curve, portions of the bag films 51 and 52, namely, the downward flow side films 51*a* and 52*a* situated in the air introduction portion 62*b*, do not follow the curving, achieving a non-deformed state. Consequently, it is possible for the deaeration valves 1 to maintain a flat state without being affected by the stuffed item, resulting in opening and closing the air passages 2 reliably. However, it is not essential to form these valve protection seals 67, and they may be omitted.

Next, a concrete description is given of a method of manufacturing the deaeration valve 1 shown in FIG. 1 and the compression bag 5 shown in FIG. 6.

A long film rolled up in the form of a roll is used for the valve films 11 and 12 according to the present embodiment. Specifically, a film having a width of 45 mm and a length of 1000 m is used.

First, a heat resistant coating 7 is coated by means of gravure printing or the like onto part of the surface of the rear side valve film 12 facing the front side valve film 11, specifically, in the vicinity of the position where the inlet 2*a* of the air passage 2 is to be formed. The width dimension of the front side valve film 11 is then reduced by approximately 5 mm. This dimensional difference forms the above-described displacement of the edges 11*a* and 12*a*.

Either of the valve films 11 and 12 is coated with silicon oil 4 onto the surface of the portion where an air passage 2 is to be formed. This coating operation may be performed by painting with a brush or the like, or by spraying.

The two valve films 11 and 12 are then placed one on the other, and a first side seal section 21 and a second side seal section 22 are formed by heat sealing the films, as illustrated in FIG. 1(A). The first side seal section 21 is formed throughout the whole width of the valve films 11 and 12 in this operation. On the other hand, the downward flow side end section 223*b* of the second side seal section 22 does not coincide with the downward flow side edges 11*b* and 12*b* of the valve films 11 and 12, thus providing a gap. This gap is the line of extension 223*c* of the seal section 22, which forms the boundary between the passage extension section 31 and the free section 32 described above.

The deaeration valve 1 formed, as shown in FIG. 1(A), in this way is sandwiched between the bag films 51 and 52, and the unifying seal section 64 is formed, thereby unifying the valve and the bag films. Side seal sections 65 are then formed on the perimeter edges of the bag films 51 and 52, except the portions where the opening 61 and the deaeration opening 63 are to be formed. At the opening 61, a fastener 61*a* of a closing means is attached. Further, as needed, a slider 8 is provided to aide opening and closing of the zip fastener 61*a*. Thus the compression bag 5 is completed.

Depending on conditions between the position where the heat resistant coating 7 is deposited in the deaeration valve 1, and the bag films 51 and 52, heat sealing is ineffective at the portion where the heat resistant coating 7 overlaps, thus the side seal sections 65 are not formed, and hence air may leak. In the present embodiment, in order to prevent disadvantage like this, inner seal sections 66 are further formed to the inner side from the side seal sections 65 formed on the right and left-hand edges of the compression bag 5 in the figure. In other words, the deaeration valve 1 is sure to be bonded to the bag films 51 and 52 at the side seal section 65 and/or inner seal section 66, except the portion such as the free section 32 where the heat resistant coating 7 is provided.

The deaeration valve 1 is not fixed to the bag films 51 and 52 at any positions other than the unifying seal section 64, the side seal sections 65 and the inner seal sections 66. Therefore, as described above, the free section 32 is hardly disturbed in absorbing distortion of the valve films 11 and 12 in the passage extension section 31.

The present invention has the following beneficial effects.

In the aspect according to claim 1, distortion in the valve films 11 and 12 in the passage extension section 31 can be eliminated, and therefore, at least in this passage extension section 31, the tension of the valve films can be stabilized, and the valve films 11 and 12 can be reliably made to closely contact together without slackening or wrinkles. Since the reliable portion of close contact like this between the valve films 11 and 12 is located adjacent to the outlet 2*b* of the air passage 2, it is possible to effectively prevent inverse flow of air in the air passage 2. Consequently, a deaeration valve that is capable of effective prevention of inverse air flow in spite of a simple structure is provided.

In the aspect according to claim 2, in addition the foregoing effects, a free section 32, which is a section adjacent to the passage extension section 31, or adjacent to the air passage 2 and the passage extension section 31, is formed, and the parts of the valve films 11 and 12 forming the passage extension section 31 and the free section 32 form a single body. Therefore, distortion of the valve films 11 and 12 in the 131 can be absorbed in the free section 32, whereby the tension in the valve films can be stabilized, at least in this passage extension section 31, and the valve films 11 and 12 can be reliably made to closely contact together without slackening or wrinkles.

In the aspect according to claim 3 or 4, in addition to the effects of the aspects above, the dimension L2*b* between the respective end sections of the first side seal section 21 and the second side seal section 22 on the outlet side of the air passage 2 is made smaller than the dimension L2*a* between the respective end sections on the inlet side, and therefore it is possible to form the free section 32 to a larger size than the passage extension section 31, and a deaeration valve in which distortion is absorbed more effectively in the free section 32 is provided.

In the aspect according to claim 5, in addition to the effects of the aspects described in claims 1 to 4, the upward flow side edge 11*a*, 12*a* of the valve film 11, 12 on one side and the upward flow side edge 12*a*, 11*a* of the valve film 12, 11 on the other side are disposed in staggered positions, towards the upward flow side and the downward flow side respectively, and therefore, it is possible to prevent the inlet 2*a* of the air passage 2 from being bonded and closed off, when the deaeration valve 1 is bonded onto the bag films 51 and 52 that form the compression bag 5. Further, this also has the action of facilitating opening of the valve films 11 and 12 during deaeration, in such a manner that the air flow f1 is smoothly introduced into the air passage 2 during deaeration.

In the aspect according to claim 6, in addition to the effects of the aspects described in any one of claims 1 to 5, an inert liquid 4 such as silicon oil is provided on at least part of the inner surfaces of the valve films 11 and 12 in the air passage 2, and therefore close contact between the valve films 11 and 12 with the air passage 2 closed can be reinforced by the viscosity of the liquid 4.

In the aspect according to claim 7 is provided a compression bag equipped with a deaeration valve capable of stabilizing tension of the valve films 11 and 12 and effective prevention of inverse air flow in spite of a simple structure, and since a heat resistant coating 7 is provided on at least part of the inner surfaces of the valve films 11 and 12 in the air passage 2 of the deaeration valve 1, then it is possible to provide a compression bag equipped with a deaeration valve in which the air passage 2 is not closed off as a result of melting of the valve films 11 and 12 due to the effects of heat during heat sealing for forming the compression bag 1.

In the aspect according to claim 8, in addition to the effects of the aspect described in claim 7, long films are used for the valve films 11 and 12, and a plurality of the aforementioned deaeration valves 1 are arranged in the lengthwise direction of the valve films 11 and 12 in such a manner that the respective air passages 2 and free sections 32 are adjacent, and therefore, combined with similarly elongate bag films 51 and 52, it is possible to continuously manufacture compression bags 2, resulting in enhancement of productive efficiency. Further, by arranging a plurality of deaeration valves 1 in this way, it is possible to readily increase the number of air passages 2 per compression bag 5, as the size, and especially, the width, of the compression bag 5 increases, and therefore it is possible to provide a compression bag equipped with a deaeration valve in which there is no difficulty in performing deaeration, even in the case of a large compression bag 5.

In the aspect according to claim 9, in addition to the effects of the aspects described in claim 7 or 8, valve protection seals 67 are formed at the boundary between an item storage portion 62*a* and an air introduction portion 62*b*, and therefore it is possible to provide a compression bag equipped with a deaeration valve capable of preventing the item such as clothing contained in the item storage portion 62*a* from being sucked into the air passage 2. Further, even when the bag films 51 and 52 are caused to curve when an item is stuffed into the item storage portion 62*a*, the portions of the bag films 51 and 52 located in the air introduction portion 62*b* do not curve accordingly, and can be maintained in a non-deformed state. Therefore, it is possible to maintain the deaeration valve 1 in a flat state, without being affected by the contained item, and hence it is possible to provide a compression bag equipped with a deaeration valve in which the air passage 2 can be opened and closed in a reliable manner.

What is claimed is:

1. A deaeration valve attached to a bag and comprising two valve films of synthetic resin that are placed one on the other and bonded at parts thereof together, thereby forming an air passage that allows to pass air through the valve films from an inlet to an outlet, the air passage being closable by the valve films that closely contact together, wherein the air passage is defined by two seal sections formed by bonding the valve films together, the inlet of the air passage being defined by a straight line linking respective upward flow side end sections of the seal sections, while the outlet of the air passage being defined by a straight line linking respective downward flow side end sections of the seal sections, the inlet being located on the downward flow side based on the direction of the air flow passing through the air passage against a storage section in the bag attaching the deaeration valve thereto, the storage section being able to contain an item for storage, and at least one of the downward flow side end sections of the seal sections and downward flow side edges of the valve films are separated, wherein the deaeration valve further comprises a non-sealed section comprising a passage extension section and a free section, the passage extension section being provided on the downward flow side of the air passage, the passage extension section being defined by the outlet of the air passage, a line of extension of the seal section on the downward flow side from at least one of the downward flow side end section of the seal sections, and the downward flow side edges of the valve films, the free section being adjacent to the passage extension section or to the air passage and the passage extension section, and further being partitioned not to allow air flow, except the air passage, from the storage section, the passage extension section and the free section being bounded by the line of extension that defines the passage extension section;

wherein the valve films are not bonded together at the lines of extension.

2. The deaeration valve 1 according to claim 1, wherein the portions of valve film constituting the passage extension section and the free section form a single body.

3. The deaeration valve according to claim 2, wherein the dimension between the respective end sections of the first side seal section and the second side seal section at the outlet of the air passage is smaller than the dimension between the respective end sections at the inlet of the air passage.

4. The deaeration valve according to claim 2, wherein, in the air passage, the upward flow side edge of the valve films that are placed one on another, and the upward flow side edge of the other of the valve films are disposed at least respectively in staggered positions towards the upward flow side and the downward flow side.

5. The deaeration valve according to claim 2, wherein an inert liquid is disposed on at least part of the inner surfaces of the valve films in the air passage.

6. The deaeration valve according to claim 1, wherein the dimension between the respective end sections of the first side seal section and the second side seal section at the outlet of the air passage is smaller than the dimension between the respective end sections at the inlet of the air passage.

7. The deaeration valve according to claim 6, wherein the first side seal section has a linear form, and the second side seal section comprises three sections that are an introduction section, an intermediate section, and an expulsion section, the intermediate section connecting between the introduction section and the expulsion section, and regarding the second side seal section, the intermediate section is formed closer to the first side seal section than the introduction section, further the expulsion section being formed closer to the first side seal section than the intermediate section, wherein the inlet of the air passage is defined by the upward flow side end section of the introduction section and the upward flow side end section of the first side seal section, while the outlet of the air passage is formed by the downward flow side end section of the introduction section and the downward flow side end section of the first side seal section, wherein the downward flow side end section of the second side seal section is formed further towards the upward flow side than the downward flow side end section of the first side seal section, and the free section being formed adjacent to the air passage and the passage extension section is provided.

8. The deaeration valve according to claim 7, wherein, in the air passage, the upward flow side edge of the valve films that are placed one on another, and the upward flow side edge of the other of the valve films are disposed at least respectively in staggered positions towards the upward flow side and the downward flow side.

9. The deaeration valve according to claim 7, wherein an inert liquid is disposed on at least part of the inner surfaces of the valve films in the air passage.

10. The deaeration valve according to claim 6, wherein, in the air passage, the upward flow side edge of the valve films that are placed one on another, and the upward flow side edge of the other of the valve films are disposed at least respectively in staggered positions towards the upward flow side and the downward flow side.

11. The deaeration valve according to claim 6, wherein an inert liquid is disposed on at least part of the inner surfaces of the valve films in the air passage.

12. The deaeration valve according to claim 1, wherein, in the air passage, the upward flow side edge of the valve films that are placed one on another, and the upward flow side edge of the other of the valve films are disposed at least respectively in staggered positions towards the upward flow side and the downward flow side.

13. The deaeration valve according to claim 12, wherein an inert liquid is disposed on at least part of the inner surfaces of the valve films in the air passage.

14. The deaeration valve according to claim 1, wherein an inert liquid is disposed on at least part of the inner surfaces of the valve films in the air passage.

15. A compression bag equipped with a deaeration valve, being a compression bag formed with at least two bag films of synthetic resin that are placed one on the other and bonded at parts thereof together, thereby comprising a storage section provided with an opening, the storage section being able to contain an item for storage, and a deaeration opening for removing air in the storage section other than the opening, wherein the respective bag films have a rectangular shape in a plan view, and the opening is provided in the upper part of the compression bag and is hermetically closable by a closing device, while the deaeration opening is provided in the lower part of the compression bag, wherein a deaeration valve according to any one of claims 1 to 6 is installed between the storage section and the deaeration opening with the inlet side of the air passage towards the top and the outlet side towards the bottom, the installation of the deaeration valve being achieved by forming a unifying seal section where the valve films and the bag films are bonded together, air being prevented from flowing between the storage section and the deaeration opening except through the air passage, wherein a heat resistant coating is disposed on at least part of the inner surfaces of the valve films in the air passage, the part being taken in a portion that coincides with the unifying seal section.

16. The compression bag equipped with a deaeration valve according to claim 15, wherein elongate films are used for the valve films and a plurality of the deaeration valves are disposed parallel in the lengthwise direction of the valve films in such a manner that the air passages and free sections are respectively adjacent.

17. The compression bag equipped with a deaeration valve according to claim 16, wherein the storage section comprises an item storage portion and an air introduction portion, the portions being bounded by a valve protection seal, the valve protection seal being formed by bonding the bag films together, wherein air is allowed to pass between the item storage section and the air introduction portion.

18. The compression bag equipped with a deaeration valve according to claim 15, wherein the storage section comprises an item storage portion and an air introduction portion, the portions being bounded by a valve protection seal, the valve protection seal being formed by bonding the bag films together, wherein air is allowed to pass between the item storage section and the air introduction portion.

* * * * *